US006612913B2

(12) United States Patent
Bailey et al.

(10) Patent No.: US 6,612,913 B2
(45) Date of Patent: Sep. 2, 2003

(54) WIRE CLEANING SYSTEM

(75) Inventors: Edwin C. Bailey, East Amherst, NY (US); Richard M. Mruk, Buffalo, NY (US)

(73) Assignee: Bison Steel, Inc., Depew, NY (US)

( * ) Notice: Subject to any disclaimer, the term of this patent is extended or adjusted under 35 U.S.C. 154(b) by 0 days.

(21) Appl. No.: 09/878,868

(22) Filed: Jun. 11, 2001

(65) Prior Publication Data

US 2001/0051498 A1 Dec. 13, 2001

Related U.S. Application Data

(60) Provisional application No. 60/210,549, filed on Jun. 9, 2000.

(51) Int. Cl.[7] ..... B24B 1/00

(52) U.S. Cl. ..... 451/59; 451/909; 15/309.1

(58) Field of Search ..... 451/36, 312, 319, 451/552, 559, 556, 554, 909, 553, 59; 15/104.04, 220.4, 256.6, 309.1

(56) References Cited

U.S. PATENT DOCUMENTS

| | | | | |
|---|---|---|---|---|
| 1,265,339 A | | 5/1918 | Jones | |
| 2,045,511 A | | 6/1936 | Babcock | |
| 2,093,680 A | | 9/1937 | Lamplough | |
| 2,284,904 A | | 6/1942 | Illmer et al. | |
| 2,329,376 A | | 9/1943 | Illmer et al. | |
| 2,570,953 A | | 10/1951 | Illmer | |
| 3,906,676 A | * | 9/1975 | Orlando, Sr. et al. | 451/49 |
| 4,543,683 A | | 10/1985 | Goldman | |
| 4,570,285 A | | 2/1986 | Skelton | |
| 5,121,573 A | | 6/1992 | Vassena | |
| 5,745,948 A | * | 5/1998 | Lloyd et al. | 15/140.12 |
| 5,991,954 A | * | 11/1999 | Kubota et al. | 15/100 |

* cited by examiner

*Primary Examiner*—Dung Van Nguyen
(74) *Attorney, Agent, or Firm*—Hodgson Russ LLP

(57) ABSTRACT

A wire cleaning system includes a pair of blocks that are generally elongated and have an internal chamber. A conduit extends from the chamber to a port disposed at the side of the block. The port is connected to an air supply. A groove is made on one side of the block. The groove generally conforms to the wire diameter or shape. Holes are made from the bottom of the groove to the chamber. An abrasive media may be placed over the holes in the groove in the blocks. A pair of the above-described blocks with media disposed in the grooves are placed on opposite sides of the wire and squeezed together by clamps, holding the media against the wire. The face on the leading side of the block is placed against a stop to prevent it from moving as the wire is pulled. Additional pairs of blocks are added as required in a radial direction to cover the entire circumference of the wire. As the wire is pulled, air is injected into the ports in the blocks. The air exits from the holes and blows off the debris from the media.

19 Claims, 2 Drawing Sheets

WIRE CLEANING SYSTEM

CROSS-REFERENCE TO RELATED APPLICATION

Applicant hereby claims priority based on U.S. Provisional Application No. 60/210,549 filed Jun. 9, 2000, entitled "Wire Cleaning System" which is incorporated herein by reference.

BACKGROUND OF THE INVENTION

There are many applications where wire, or other round, square or shaped profile rod or pipe, must be cleaned to remove rust, paint, scale, etc., to prepare the surface for subsequent processing. The techniques available for cleaning wire consist of batch and continuous processes. In a batch process the entire coil of wire is cleaned at one time. In a continuous process the wire is cleaned as it is fed off the coil. While both processes require a large amount of space, batch processes generally require more space. Extra material handling is also required with batch processes. The main techniques include acid cleaning, shot blasting, ultrasonic cleaning, grinding or mechanical methods.

Acid cleaning consists of using an acid, such as a sulfuric or hydrochloric acid solution, to dissolve the surface contaminate from the wire. This can be a batch process where the coil is immersed in an acid bath for five to twenty minutes or a continuous process where the wire is pulled through a trough that is filled with acid. This method will clean the wire very thoroughly. However, it is very expensive to build and to operate an acid cleaning system because of the safety and environmental hazards associated with handling acid. Also, the process must be carefully controlled so the wire itself is not dissolved.

Shot blasting consists of blasting the wire surface with abrasive media such as steel shot, sand or glass beads. This method can be a batch process where the entire coil of wire is put in a large blast cabinet or a continuous process where the wire is pulled through a small blasting chamber. With both processes, the wire is blasted either through multiple nozzles or by spinning wheels throwing the shot to clean the surface. The equipment used to blast wire is very expensive. Batch processing equipment is expensive to maintain as the process is inherently self-destructive. Also, it can be difficult to clean the entire circumference effectively. The continuous process has high operating cost because a large volume of compressed air or electrical power is required to propel the shot. It can also be a slow process.

Ultrasonic cleaning consists of pulling the wire continuously through an aqueous solution while the wire is subjected to ultrasonic vibrations which essentially cause the contaminate to implode from the wire surface. This equipment is expensive and currently can remove only limited types of contaminates. It can also be a slow process.

Grinding consists of using a series of grinders with abrasive wheels, made from wire or synthetic materials, which rub against the wire to clean it as it is pulled by in a continuous process. The system required to grind wire is cheaper than the above methods but is still relatively expensive. Also, it is particularly difficult to control both the pressure of the wheels against the wire and the wire speed so that the wire is cleaned thoroughly while not abrading the wire surface itself. The wheels must also be strategically placed so that they clean the entire circumference of the wire.

Mechanical methods consist of bending the wire in one or more U shapes to crack semi-brittle, hard-to-remove surface contaminates so the material can be more easily removed subsequently by another method such as grinding. This method can be relatively expensive. It is limited to wire which is fairly flexible and can tolerate the severe bends without breaking.

Abrasive media, such as sandpaper or synthetic pads or grids can effectively and economically remove scale, etc. from wire. However, if they are applied against the wire in a continuous process, they can plug with debris, lose their abrasiveness, and stop cleaning the surface effectively. The media then has to be removed, cleaned off, and reapplied. These maintenance requirements can make them impractical to use.

Accordingly, there remains a need for an economic, environmentally manageable solution for cleaning wire.

SUMMARY OF THE INVENTION

The present invention meets the above-described need by providing a relatively small block that is generally elongated and has an internal chamber. A port extends to the chamber from a side of the block and is connected to an air supply. A groove is made on one side of the block. The groove generally conforms to the wire diameter or shape. Holes are made from the bottom of the groove to the chamber. An abrasive media is placed over the holes in the groove on two of the blocks. A pair of the above-described blocks with the media in the grooves are placed on opposite sides of the wire and squeezed together by clamps, holding the media against the wire. The face on the leading side of the block is placed against a stop to prevent it from moving as the wire is pulled. Additional pairs of blocks are added as required in a radial direction to cover the entire circumference of the wire. As the wire is pulled, air is injected into the ports in the blocks. The air exits from the holes and blows off the debris from the media. The air may be continuous or intermittent. As a result an economical, relatively low maintenance system and method for cleaning wire has been achieved.

DETAILED DESCRIPTION OF THE INVENTION

Figure 1:
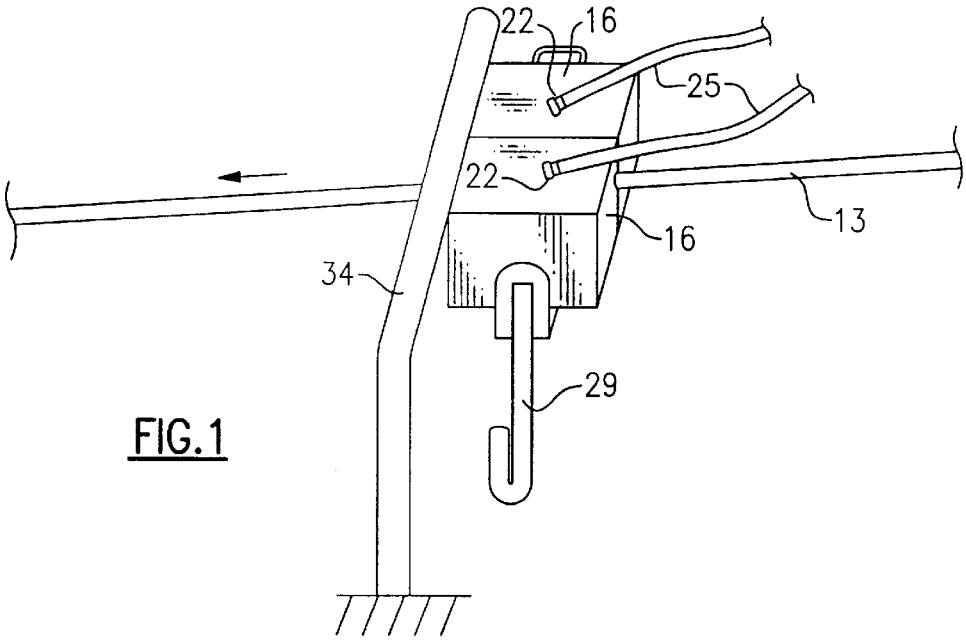
FIG. 1 is a perspective view of the wire cleaning system of the present invention.

Referring generally to FIGS. 1–7, and initially to FIG. 1, the present invention consists of a continuous method of pressing a media 10 (FIG. 6) against a wire 13 as it is pulled through a pair of stationary blocks 16. The media 10 preferably comprises a screen-like or fiber mesh impregnated and/or coated with an abrasive material or grit. Numerous types of this media are commercially available. Relatively small amounts of air are injected intermittently through conduits 25 connected to ports 22 as will be described hereinafter. The air is injected through and/or around the media 10 to remove any accumulated debris so that the media 10 continues to clean the wire 13. The media 10 is inexpensive and is durable enough to clean thousands of feet of wire 13 without wearing out. The media 10 will clean the wire 13 while it is moving past, even at high speeds, but will not abrade the wire 13 if the wire 13 stops moving.

The stationary blocks 16 are clamped together around the wire 13 by means of mechanical C-shaped clamps 29. Other clamps for holding the blocks 16 together would also be suitable. A mechanical stop 34 prevents the blocks 16 from moving forward. Mechanical stop 34 is shown attached to the ground.

Figure 4:
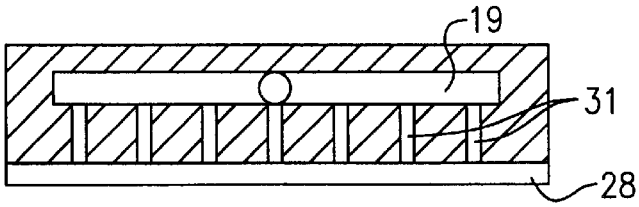
FIG. 4 is a sectional view taken along lines 4—4 in FIG. 3.
Figure 5:
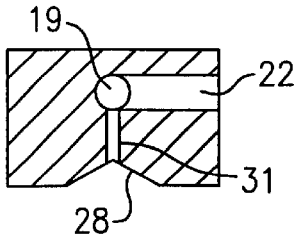
FIG. 5 is a sectional view taken along lines 5—5 in FIG. 3.

Referring to FIGS. 2–5, the invention consists of a relatively small block 16 that is generally elongated and has an internal chamber 19. The internal chamber 19 may be formed by a hole that is drilled longitudinally through the block 16. As best shown in FIG. 4, the hole is drilled through almost the entire length of the block 16 and then the open end is plugged to form internal chamber 19. A port 22 (FIG. 2) is made from the chamber 19 to a side of the block 16 and is connected to conduit 25 leading to a source of pressurized gas 26. A groove 28 is made on one side of the block 16 which generally conforms to the wire 13 diameter or shape. In order to accommodate wire 13 having different diameters, a V-shaped groove 28 may be provided. As best shown in FIG. 5, holes 31 are made from the bottom of the groove 28 to the chamber 19.

Figure 6:
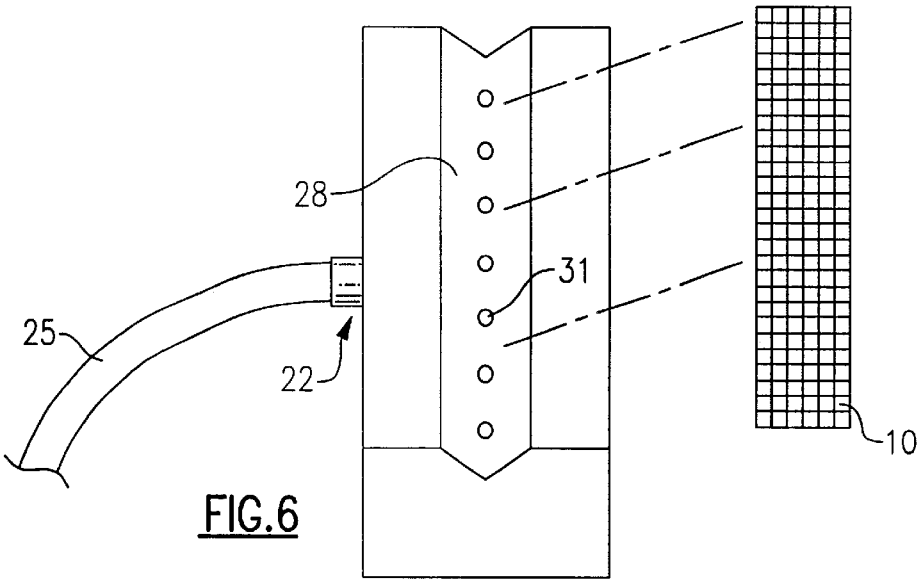
FIG. 6 is a perspective view of the cleaning module.
Figure 7:
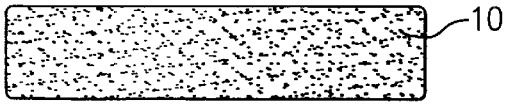
FIG. 7 is a top plan view of an alternate cleaning media.
Figure 2:
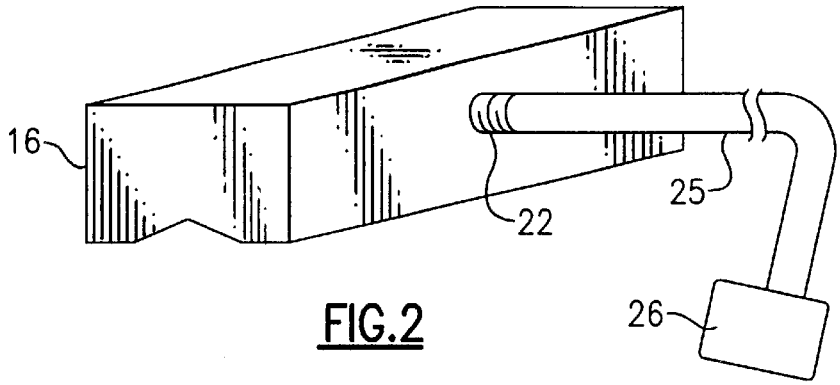
FIG. 2 is a perspective view of one of the wire cleaning modules of the present invention.
Figure 3:
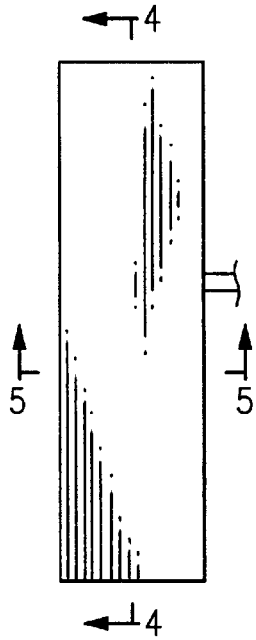
FIG. 3 is a top plan view of the cleaning module of FIG. 2.

As shown in FIG. 6, the abrasive media 10 is placed over the holes in the groove 28 on two of the blocks 16. Returning to FIG. 1, the blocks 16 with the media 10 in the grooves are placed on opposite sides of the wire 13 and squeezed together by clamps 29, holding the media 10 against the wire 13. The face on the leading side of the block 16 is placed against a stop 34 to prevent it from moving as the wire 13 is pulled. Additional pairs of blocks 16 may be added as required in a radial direction to cover the entire circumference of the wire 13. As the wire 13 is pulled, air is injected into the ports 22 in the blocks 16 which then comes out of the holes and blows off the debris from the media 10. The air may be continuous or intermittent.

Normally, only three feet or less of the wire length is required for the entire system. It can be enclosed so that the resulting dust can be collected by a simple vacuum system.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A wire cleaning block, comprising:

a block member having a chamber defined therein and having at least one side with a groove defined therein, the groove having at least one aperture defined therein, the aperture disposed in fluid communication with the chamber;

at least one conduit disposed in fluid communication with the chamber; and, a screen disposed in the groove in the block member.

2. The wire cleaning block of claim 1, wherein the conduit is connected to a source of pressurized gas.

3. The wire cleaning block of claim 1, wherein the at least one aperture comprises a plurality of apertures.

4. A wire cleaning block, comprising:

a block member having a chamber defined therein and having at least one side with a groove defined therein, the groove having at least one aperture defined therein, the aperture disposed in fluid communication with the chamber;

at least one conduit disposed in fluid communication with the chamber; and, a fiber mesh impregnated with an abrasive material, the fiber mesh disposed in the groove in the block member.

5. The wire cleaning block of claim 4, wherein the conduit is connected to a source of pressurized gas.

6. The wire cleaning block of claim 4, wherein the at least one aperture comprises a plurality of apertures.

7. A wire cleaning block, comprising:

a block member having a chamber defined therein and having at least one side with a V-shaped groove defined therein, the groove having at least one aperture defined therein, the aperture disposed in fluid communication with the chamber;

at least one conduit disposed in fluid communication with the chamber; and, an abrasive media disposed in the groove in the block member.

8. A system for cleaning a wire, the system comprising:

at least two blocks, each block having a chamber defined therein and having at least one side with a groove defined therein, the groove having at least one aperture defined therein, the aperture disposed in fluid communication with the chamber;

at least one conduit in fluid communication with the chamber of each block;

an abrasive media disposed in the groove in each block;

a clamp disposed so as to hold the at least two blocks together;

a mechanical stop disposed adjacent to the blocks so that the at least two blocks are held stationary while the wire is pulled through the at least two blocks.

9. The system of claim 8, wherein the abrasive media comprises a screen.

10. The system of claim 8, wherein the abrasive media comprises a fiber mesh impregnated with an abrasive material.

11. The system of claim 8, wherein the conduit is connected to a source of pressurized gas.

12. The system of claim 8, wherein the at least one aperture comprises a plurality of apertures.

13. The system of claim 8, wherein the clamp further comprises a C-shaped clamp.

14. The system of claim 8, wherein the mechanical stop is supported from the ground.

15. The system of claim 8, wherein the mechanical stop is fixedly attached to the ground.

16. The system of claim 8, wherein the groove on each of the blocks is V-shaped.

17. A method for cleaning a wire, the method comprising:

providing at least two blocks, each block having a chamber defined therein and having at least one side with a groove defined therein, the groove having at least one aperture defined therein, the aperture disposed in fluid communication with the chamber;

providing at least one conduit in fluid communication with the chamber of each block;

providing an abrasive media disposed in the groove in each block;

providing a clamp disposed so as to hold the at least two blocks together;

providing a mechanical stop disposed adjacent to the blocks so that the at least two blocks are held stationary while the wire is pulled through the at least two blocks; and, pulling the wire through the blocks while the blocks are held stationary.

18. The method of claim 17, wherein the abrasive media comprises a screen.

19. The method of claim 17, wherein the abrasive media comprises a fiber mesh impregnated with an abrasive material.

* * * * *